US009694586B1

(12) United States Patent
Lee

(10) Patent No.: US 9,694,586 B1
(45) Date of Patent: Jul. 4, 2017

(54) INK CARTRIDGE, FOR INKJET PRINTER, ENABLING REFILLING OF INK BY USER

(71) Applicant: WOOSIM SYSTEM INC., Seoul (KR)

(72) Inventor: Il Bok Lee, Gyeonggi-do (KR)

(73) Assignee: WOOSIM SYSTEM INC., Seoul (KR)

( * ) Notice: Subject to any disclaimer, the term of this patent is extended or adjusted under 35 U.S.C. 154(b) by 0 days.

(21) Appl. No.: 15/115,900

(22) PCT Filed: Mar. 27, 2015

(86) PCT No.: PCT/KR2015/003053
§ 371 (c)(1),
(2) Date: Aug. 1, 2016

(87) PCT Pub. No.: WO2016/013748
PCT Pub. Date: Jan. 28, 2016

(30) Foreign Application Priority Data

Jul. 24, 2014 (KR) ..... 10-2014-0093843

(51) Int. Cl.
*B41J 2/175* (2006.01)

(52) U.S. Cl.
CPC ..... *B41J 2/17506* (2013.01); *B41J 2/17513* (2013.01); *B41J 2/17553* (2013.01); *B41J 2002/17516* (2013.01)

(58) Field of Classification Search
CPC B41J 2/17506; B41J 2/17553; B41J 2/17513; B41J 2002/17516
See application file for complete search history.

(56) References Cited

U.S. PATENT DOCUMENTS

2015/0367648 A1* 12/2015 Kimura ..... B41J 2/17509 347/86

FOREIGN PATENT DOCUMENTS

| | | | |
|---|---|---|---|
| JP | 2012-171248 | A | 9/2012 |
| KR | 10-2001-0037240 | A | 5/2001 |
| KR | 10-2002-0088439 | A | 11/2002 |
| KR | 10-2003-0050980 | A | 6/2003 |

(Continued)

OTHER PUBLICATIONS

Korean Patent Abstract (in English) of KR Pub. No. 10-2001-0037240 A, Pub. Date May 7, 2001, downloaded Jul. 13, 2016 from http://kpa.kipris.or.kr/kpa/.

(Continued)

*Primary Examiner* — Bradley Thies
(74) *Attorney, Agent, or Firm* — Barcelo, Harrison & Walker, LLP

(57) ABSTRACT

The present invention relates to an ink cartridge for an inkjet printer, the ink cartridge having a separate refilling port formed on the upper surface of a main body housing in which ink is stored and having mounted a port cover for opening and closing the refilling port, thereby enabling convenient refilling of ink through the refilling port by an individual user even without using a separate working tool or a specialized company for refilling ink. In addition, by having formed a display window for observing, with the naked eye from the outside, the amount of ink being refilled, the ink cartridge enables the user to easily perceive time for refilling ink. Also, by preventing the ink from being refilled too much or too little when the ink is being refilled, the ink cartridge enables refilling of an appropriate amount of the ink.

5 Claims, 6 Drawing Sheets

(56) References Cited

FOREIGN PATENT DOCUMENTS

| | | | |
|---|---|---|---|
| KR | 20-0329350 | Y1 | 10/2003 |
| KR | 10-0732468 | B1 | 6/2007 |

OTHER PUBLICATIONS

Korean Patent Abstract (in English) of KR Pub. No. 10-2002-0088439 A, Pub. Date Nov. 29, 2002, downloaded Sep. 27, 2016 from http://kpa.kipris.or.kr/kpa/.
Korean Patent Abstract (in English) of KR Utility Model No. 20-0329350 Y1, Pub. Date Oct. 10, 2003, downloaded Sep. 27, 2016 from http://kpa.kipris.or.kr/kpa/.
Korean Patent Abstract (in English) of KR Pub. No. 10-2003-0050980 A, Pub. Date Jun. 25, 2003, downloaded Jul. 13, 2016 from http://kpa.kipris.or.kr/kpa/.
Korean Patent Abstract (in English) of KR Patent No. 10-0732468 B1, Pub. Date Jun. 27, 2003, downloaded Sep. 27, 2016 from http://engpat.kipris.or.kr/kpa/.
Japanese Patent Abstract (in English) of JP Pub. No. 2012-171248 A, Pub. Date Sep. 10, 2012, downloaded Jul. 17, 2016 from http://www4.j-platpat.inpit.go.jp/eng/tokujitsu.

* cited by examiner

INK CARTRIDGE, FOR INKJET PRINTER, ENABLING REFILLING OF INK BY USER

CROSS-REFERENCE TO RELATED APPLICATIONS

This application is the national stage for International Patent Cooperation Treaty Application PCT/KR2015/003053, filed Mar. 27, 2015, which claims priority from Korean Patent Application No. 10-2014-0093843, filed Jul. 24, 2014, in the Korean Intellectual Property Office. The entire contents of said applications are incorporated herein by reference for all purposes.

BACKGROUND

Technical Field

The present invention relates to a reusable ink cartridge for an inkjet printer, and more particularly, to a reusable ink cartridge for an inkjet printer, the reusable ink cartridge having a separate refilling port at a top surface of a main body housing where ink is stored and having a port cover for opening and closing the refilling port such that an individual user conveniently refills ink through the refilling port without having to use a separate working tool or a specialized company for refilling ink, having a display window for observing, with naked eyes from the outside, an ink storage amount in the main body housing and an ink refilling amount such that the individual user may easily determine a time for refilling ink and refills a suitable amount of ink while refilling the ink by preventing over-filling or under-filling of the ink, and having a refill bag formed of a ductile material inside the main body housing and storing ink therein such that even if the ink storage amount is reduced based on ink usage, a vacuum pressure is prevented from being generated inside the refill bag via narrowing deformation thereby preventing an unstable state of ink supply and discharge caused by the vacuum pressure and smoothly and stably supplying and discharging ink from an ink ejecting unit.

Background Art

Generally, an ink cartridge used in an inkjet printer includes an ink container in which ink is stored and a head unit through which ink is ejected, and printing is performed as ink is ejected onto a paper according to a print command of the inkjet printer.

Since the ink cartridge used as such is disposable, the ink cartridge is replaced when ink stored therein is all consumed, but recently, for resource recycling and environmental pollution prevention, the ink cartridge, in which the ink is all consumed, is not discarded and is reused by refilling ink. Since it is cheaper to refill ink than replacing the ink cartridge, refilling of ink is advantageous economically, and in particular, utilization and importance of the refilling of ink is gradually increasing since an environment is protected and resources are not wasted.

A method of refilling ink to reuse the ink cartridge is varied since a structure of the ink cartridge is various based on a manufacture company and a product model of the inkjet printer, and a most frequently used method is using a syringe. In other words, a certain amount of ink is sucked into the syringe while a needle of the syringe is dipped in ink in a storage container, and then needle is inserted into the ink cartridge to discharge, from the syringe, and inject the sucked ink into the ink cartridge.

However, such a method of using the syringe is inconvenient since ink is sucked into the syringe by dipping the needle in the storage container and then injected by inserting the needle into a hole of the ink cartridge, and moreover, while performing the method, ink may drop or spill and stain the periphery.

Also, specialized companies for refilling ink in the ink cartridge have been emerged recently, and such specialized companies make a separate ink refill hole in the ink cartridge to refill ink and then block the separate ink refill hole by using a stopper to reuse the ink cartridge.

In this case as well, ink is refilled by using equipment of the specialized companies, and thus it is very difficult for an individual user to easily refill ink.

DETAILED DESCRIPTION OF THE INVENTION

Technical Problem

One or more embodiments of the present invention provide an ink cartridge for an inkjet printer, the ink cartridge having a separate refilling port at a top surface of a main body housing where ink is stored and having a port cover for opening and closing the refilling port such that an individual user conveniently refills ink through the refilling port without having to use a separate working tool or a specialized company for refilling ink.

One or more embodiments of the present invention provide an ink cartridge for an inkjet printer, the ink cartridge having a display window for observing, with naked eyes from the outside, an ink storage amount in a main body housing and an ink refilling amount such that a user may easily determine a time for refilling ink and refills a suitable amount of ink while refilling the ink by preventing over-filling or under-filling of the ink.

One or more embodiments of the present invention provide an ink cartridge for an inkjet printer, the ink cartridge having a refill bag formed of a ductile material inside a main body housing and storing ink therein such that even if an ink storage amount is reduced based on ink usage, a vacuum pressure is prevented from being generated inside the refill bag via narrowing deformation thereby preventing an unstable state of ink supply and discharge caused by the vacuum pressure and smoothly and stably supplying and discharging ink from an ink ejecting unit.

Technical Solution

According to an aspect of the present invention, there is provided a reusable ink cartridge for an inkjet printer, the reusable ink cartridge including: a main body housing having an ink storage chamber in which ink is stored; a refilling port provided at an upper surface of the main body housing such that ink is refilled in the ink storage chamber of the main body housing; and a port cover detachably combined to the refilling port to open or close the refilling port, wherein the ink cartridge is used by refilling ink in the ink storage chamber through the refilling port.

A storage amount display window may be provided at a side lower portion of the main body housing such that a storage height of ink stored in the ink storage chamber is observed with naked eyes from the outside, and a refilling amount display window may be provided at a side upper portion of the main body housing such that a refilling height of ink is observed with naked eyes from the outside while refilling ink in the ink storage chamber.

An infrared filter or ultraviolet filter may be mounted on the storage amount display window and the refilling amount display window such that infrared rays or ultraviolet rays are blocked.

The reusable ink cartridge may further include a refill bag formed of a ductile material inside the ink storage chamber to store ink therein, wherein the refill bag may be communicably mounted on the refilling port such that ink refilled through the refilling port flows into and stored in an inner space of the refill bag.

An air vent may be provided at one side of the main body housing such that external air flows into and discharges from an inner space of the ink storage chamber.

The refill bag may have a refilling inlet hole to communicate with the refilling port, wherein the refilling inlet hole may be communicably fixed to the refilling port via a separate adhesive.

Advantageous Effects

According to the present invention, an ink cartridge for an inkjet printer has a separate refilling port at a top surface of a main body housing where ink is stored and has a port cover for opening and closing the refilling port such that an individual user conveniently refills ink through the refilling port without having to use a separate working tool or a specialized company for refilling ink.

Also, the ink cartridge has a display window for observing, with naked eyes from the outside, an ink storage amount in the main body housing and an ink refilling amount such that a user may easily determine a time for refilling ink and refills a suitable amount of ink while refilling the ink by preventing over-filling or under-filling of the ink.

Also, by separately forming an ink storage amount display window and an ink refilling amount display window respectively at a lower portion and an upper portion of the main body housing, sizes thereof may be reduced, and accordingly, exposure of ink stored in the ink cartridge to external light may be minimized, thereby preventing properties and characteristics of ink from being changed.

Also, the ink cartridge has a refill bag formed of a ductile material inside the main body housing and stores ink therein such that even if the ink storage amount is reduced based on ink usage, a vacuum pressure is prevented from being generated inside the refill bag via narrowing deformation thereby preventing an unstable state of ink supply and discharge caused by the vacuum pressure and smoothly and stably supplying and discharging ink from an ink ejecting unit.

DETAILED DESCRIPTION

Best Mode

Figure 1:
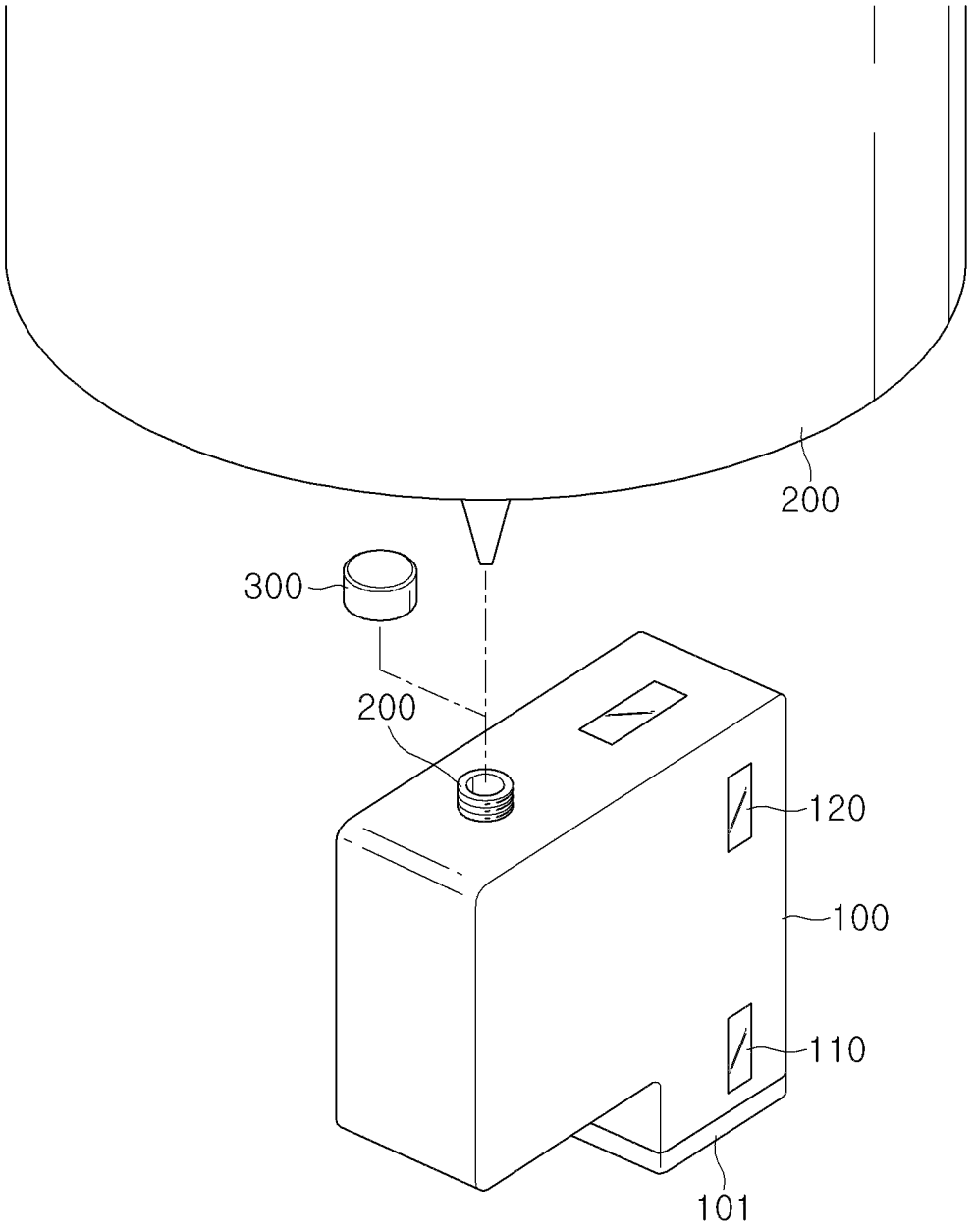
FIG. 1 is a perspective view schematically illustrating an outer shape of a reusable ink cartridge for an inkjet printer, according to an embodiment of the present invention.

Hereinafter, one or more embodiments of the present invention will now be described with reference to accompanying drawings. First, in drawings, like reference numerals denote like elements. Also, in the description of the present invention, certain detailed explanations of related art are omitted when it is deemed that they may unnecessarily obscure the essence of the invention.

Figure 2:
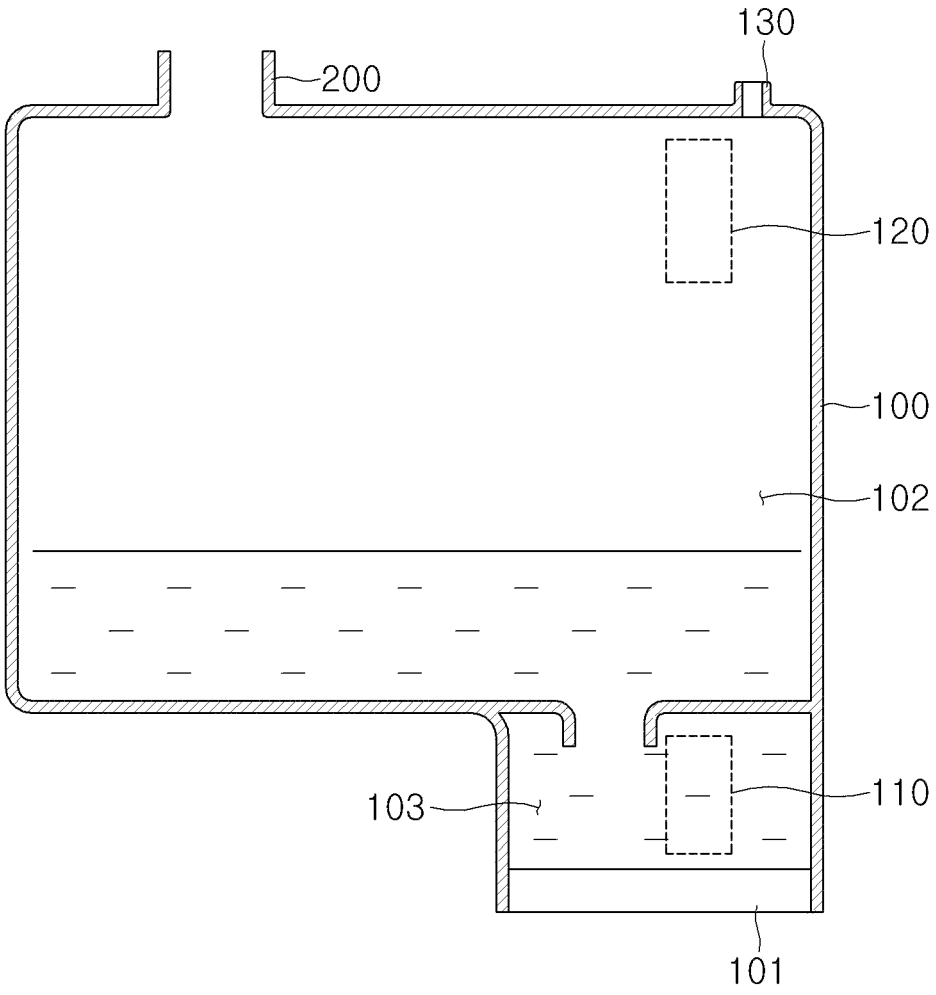
FIG. 2 is a cross-sectional view schematically illustrating an internal structure of a reusable ink cartridge for an inkjet printer, according to an embodiment of the present invention.

FIG. 1 is a perspective view schematically illustrating an outer shape of a reusable ink cartridge for an inkjet printer, according to an embodiment of the present invention, and FIG. 2 is a cross-sectional view schematically illustrating an internal structure of the reusable ink cartridge for an inkjet printer, according to an embodiment of the present invention.

The ink cartridge for an inkjet printer according to an embodiment of the present invention enables an individual user to easily refill ink without having to use a separate working tool, and includes a main body housing 100, a refilling port 200, and a port cover 300.

The main body housing 100 includes an ink storage chamber 102 in which ink L is stored in an internal space, wherein a shape of the ink storage chamber 102 may vary according to a type of a printer. An ejecting unit 101 for ejecting the ink L stored in the ink storage chamber 102 is provided at the bottom of the main body housing 100, and a print operation is performed as ink is ejected onto a print paper therethrough. Also, an ejection storage unit 103 temporarily storing ink to be ejected through the ejection unit 101 is provided at a lower space of the ink storage chamber 102 in the internal space of the main body housing 100 to communicate with the ink storage chamber 102. Accordingly, ink stored in the ink storage chamber 102 flows into the ejection storage unit 103 and externally ejected through the ejecting unit 101 while being temporarily stored.

The refilling port 200 is provided at a top surface of the main body housing 100 such that the ink L is refilled in the ink storage chamber 102 of the main body housing 100. Such a refilling port 200 may be provided such that a separate ink storage container 400 for ink refill is inserted as shown in FIGS. 1 and 2. The refilling port 200 may protrude upward at the top surface of the main body housing 100, but a shape of the refilling port 200 may vary according to needs of a user, for example, the main body housing 100 may have a simple through hole shape at the top surface of the main body housing 100 *r* may protrude downward at the top surface of the main body housing 100.

The port cover 300 is detachably combined to the refilling port 200 to open or close the refilling port 200. The port cover 300 may be combined to the refilling port 200 via any one of various methods, for example, by using a screw or by inserting the port cover 300 into the refilling port 200 via a fitting manner. In FIG. 1, the port cover 300 is completely detached from the refilling port 200, but when the port cover 300 is separated from the refilling port 200 to perform an ink refill operation, the port cover 300 may be lost or damaged by mistake during the ink refill operation. Thus, the port cover 300 may be connected to the main body housing 100 via a separate connection wire (not shown) or the like.

As such, in the ink cartridge according to an embodiment of the present invention, since the refilling port 200 is provided at the top surface of the main body housing 100 in which the ink L is stored, the individual user may easily refill ink through the refilling port 200 without having to use a separate specialized company for refilling ink or a working tool.

In particular, since the refilling port 200 may be opened or closed by using the port cover 300, the refilling port 200 may be opened only when the ink L is to be refilled and may maintain a closed state after ink refill is completed, and thus ink may be conveniently refilled without having to use a separate working tool.

Meanwhile, since the ink cartridge according to an embodiment of the present invention is used as the individual user refills the ink L, it is preferable that separate components for the individual user to conveniently refill ink may be added.

Accordingly, a storage amount display window 110 may be provided at a side lower portion of the main body housing to observe, with naked eyes from the outside, a storage height of the ink L stored in the ink storage chamber 102. Accordingly, when a storage amount of the ink L stored in the ink storage chamber 102 of the main body housing 100 is lower than or equal to a certain height, the user may easily detect the storage amount through the storage amount display window 110 and determine a time to refill the ink L. Of course, the storage amount display window 110 may be provided to observe the internal space of the ink storage chamber 102, or as shown in FIGS. 1 and 2, provided to observe the internal space of the ejection storage unit 103.

Also, since the main body housing 100 is formed of an opaque material to prevent the ink L stored therein from being exposed to external light, the user is unable to observe a refilling height, i.e., how much the ink L is refilled, while refilling the ink L in the ink storage chamber 102. Thus, the ink L may overflow outside the main body housing 100 due to over-filling of the ink L or may be used up soon due to under-filling of the ink L and need to be refilled again after a short period of time, and thus the user may be inconvenienced.

Accordingly, a refilling amount display window 120 may be provided at a side upper portion of the main body housing 100 such that a refilling height of the ink L is observed with naked eyes outside while refilling the ink L to the ink storage chamber 102.

Accordingly, while the user refills the ink L, the user may observe the refilling height of the ink L through the refilling amount display window 120 with naked eyes, thereby preventing over-filling or under-filling of the ink L.

Here, the storage amount display window 110 and the refilling amount display window 120 may have small sizes while being separated respectively at the side lower portion and the side upper portion of the main body housing 100, and accordingly, exposure of the ink L stored in the ink storage chamber 102 to external light may be reduced, thereby satisfactorily maintaining characteristics of the ink L.

In other words, when the ink L is exposed to infrared rays or ultraviolet rays, components or characteristics of the ink L are changed and thus the ink L may not perform a normal function. In order to reduce changes of the components and characteristics, the storage amount display window 110 and the refilling amount display window 120 may have small sizes while being separated respectively at the side lower portion and the side upper portion of the main body housing 100, and thus exposure of the ink L to light may be reduced.

In addition, the storage amount display window 110 and the refilling amount display window 120 may include a separate infrared filter or ultraviolet filter to block infrared rays or ultraviolet rays, and thus exposure of the ink L to external light may be further reduced.

Figure 3:
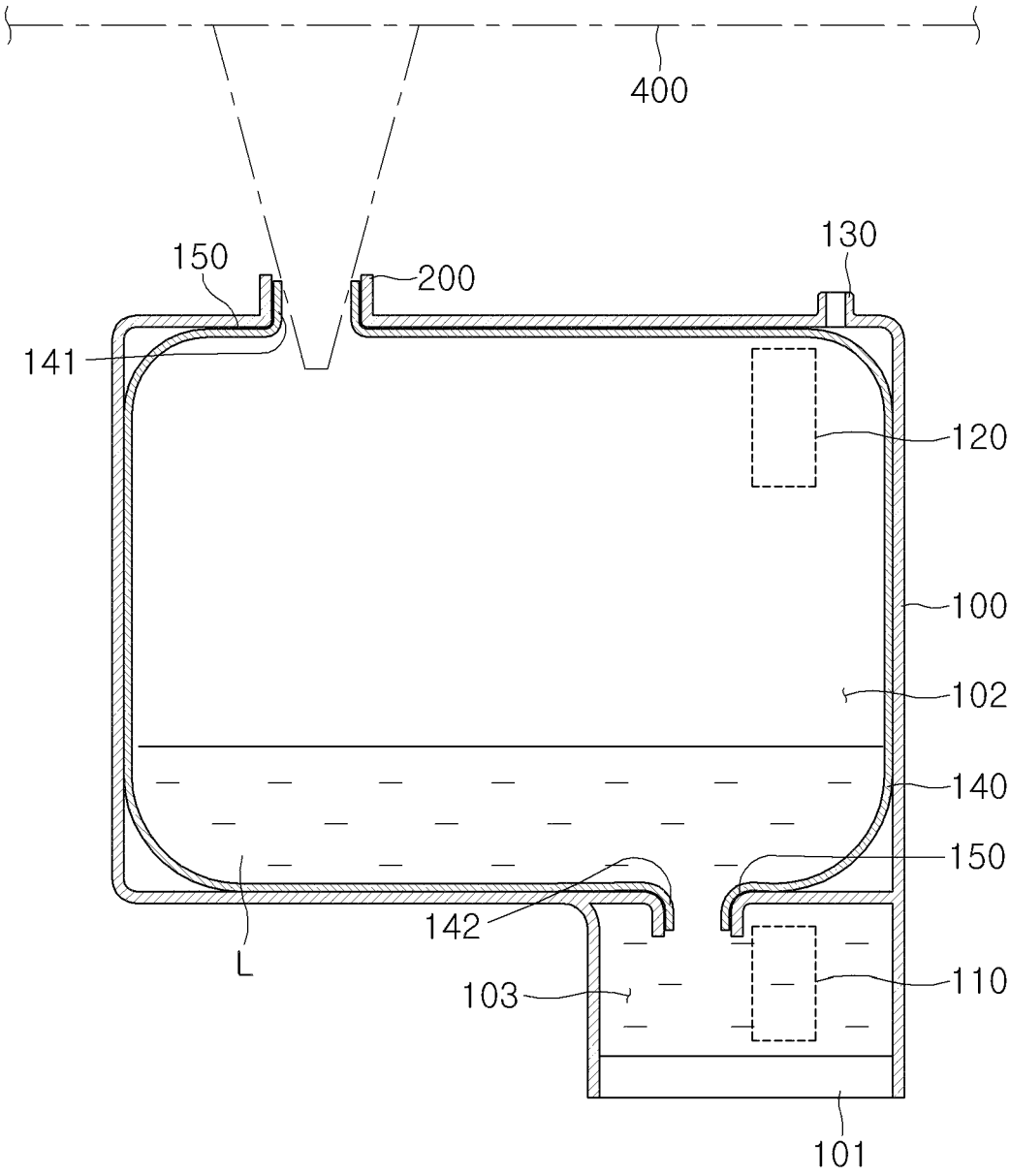
FIG. 3 is a cross-sectional view schematically illustrating an internal structure of a reusable ink cartridge for an inkjet printer, according to another embodiment of the present invention.
Figure 4:
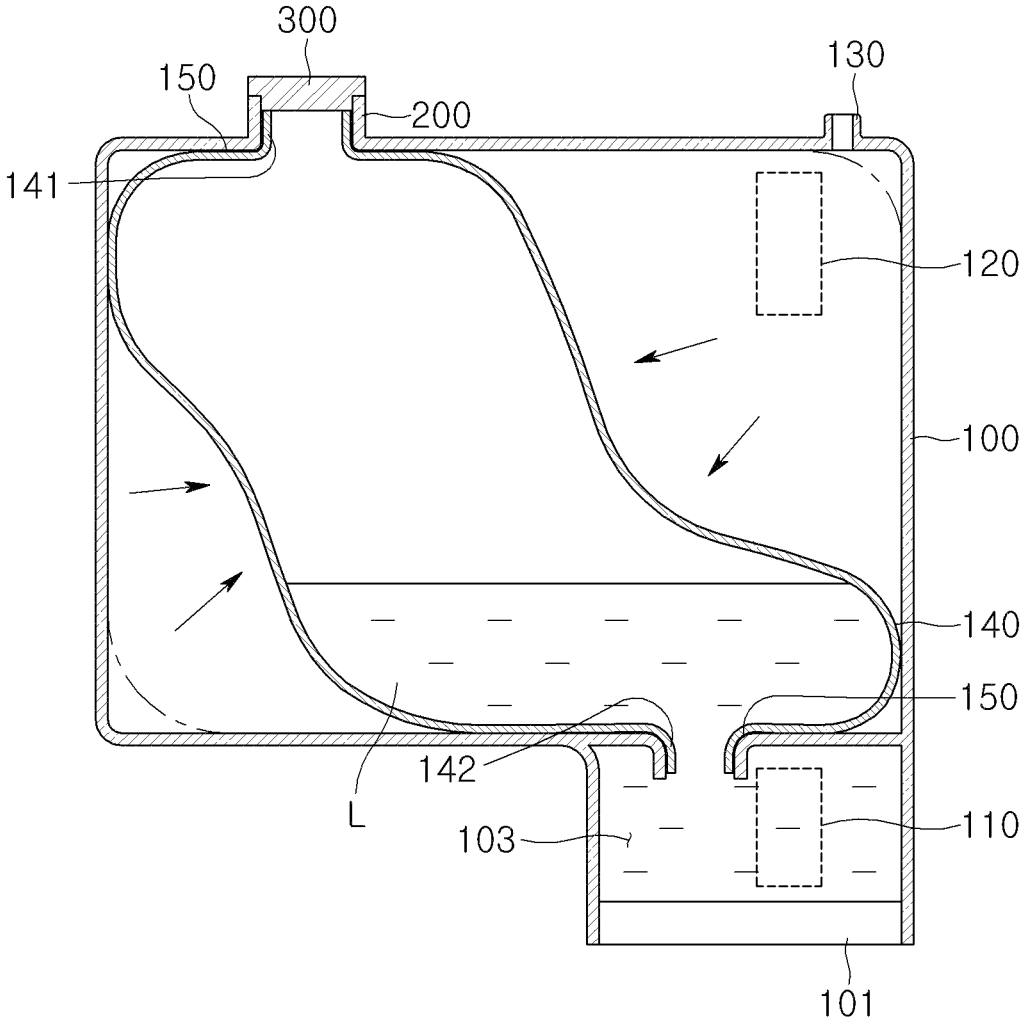
FIG. 4 is a view schematically illustrating a use state of the ink cartridge of FIG. 3.

FIG. 3 is a cross-sectional view schematically illustrating an internal structure of a reusable ink cartridge for an inkjet printer, according to another embodiment of the present invention, and FIG. 4 is a view schematically illustrating a use state of the ink cartridge of FIG. 3.

The ink cartridge for an inkjet printer, according to an embodiment of the present invention, may further include a refill bag 140 provided inside the ink storage chamber 102 of the main body housing 100 as shown in FIGS. 3 and 4.

The refill bag 140 may be provided such that ink is stored in an internal space and may be formed of a ductile material, such as vinyl, such that a shape thereof is changed based on a storage amount of ink. The refill bag 140 is communicably mounted on the refilling port 200 such that ink refilled through the refilling port 200 from the ink storage container 400 flows to an internal space of the refill bag 140 and stored therein.

In detail, a refilling inlet hole 141 communicating with the refilling port 200 may be formed at the top of the refill bag 140, and the refilling inlet hole 141 may be communicably fixed to the refilling port 200 via a separate adhesive 150. Of course, the refilling inlet hole 141 may be communicably fixed to the refilling port 200 through another fixing unit aside from the adhesive 150. Also, a supply and discharge hole 142 may be provided at the bottom of the refill bag 140 such that ink stored in the internal space of the refill bag 140 is discharged and supplied towards the ejection storage unit 110, and accordingly, ink stored in the internal space of the refill bag 140 is discharged and supplied towards the ejection storage unit 110 continuously via self-weight.

When the ink is stored in the internal space of the ink storage chamber 102 by separately using the refill bag 140 as such, the stored ink may be smoothly discharged and supplied towards the ejection storage unit 110. In other words, after the ink is refilled in the ink storage chamber 102, the refilling port 200 is closed by the port cover 300 and the internal space of the ink storage chamber 102 is sealed, and in this case, when the storage amount of ink stored in the ink storage chamber 102 is reduced by using the ink, vacuum pressure is generated in the internal space of the ink storage chamber 102 and thus the ink may not be smoothly supplied and discharged to the ejection storage unit 110 from the ink storage chamber 102. In an embodiment of the present invention, the refill bag 140 for storing ink is provided in the internal space of the ink storage chamber 102 such that even if vacuum pressure is generated as the storage amount of ink stored in the refill bag 140 is reduced by using the ink, the shape of the refill bag 140 is narrowed accordingly as shown in FIG. 4, and according to such a shape change of the refill bag 140, vacuum pressure is not generated in the internal space of the refill bag 140. Thus, even if the storage amount of ink is reduced by using the ink, ink is smoothly supplied and discharged to the ejection storage unit 110.

Meanwhile, in this case, when the shape of the refill bag 140 is narrowed, vacuum pressure may be generated in the internal space of the ink storage chamber 102 in the same principle described above, and thus according to an embodiment of the present invention, an air vent 130 may be provided at one side of the main body housing 100 such that external air is introduced into and discharged from the internal space of the ink storage chamber 102.

Since the ink storage chamber 102 communicates with an external space and air may pass through the air vent 130, vacuum pressure is not generated in the ink storage chamber

102, and thus narrowing deformation of the refill bag 140 may be smoothly performed. Under the similar principle, the refill bag 140 may also smoothly expand while refilling ink in the refill bag 140, and thus an ink refill operation may be smoothly and stably performed.

Figure 5:
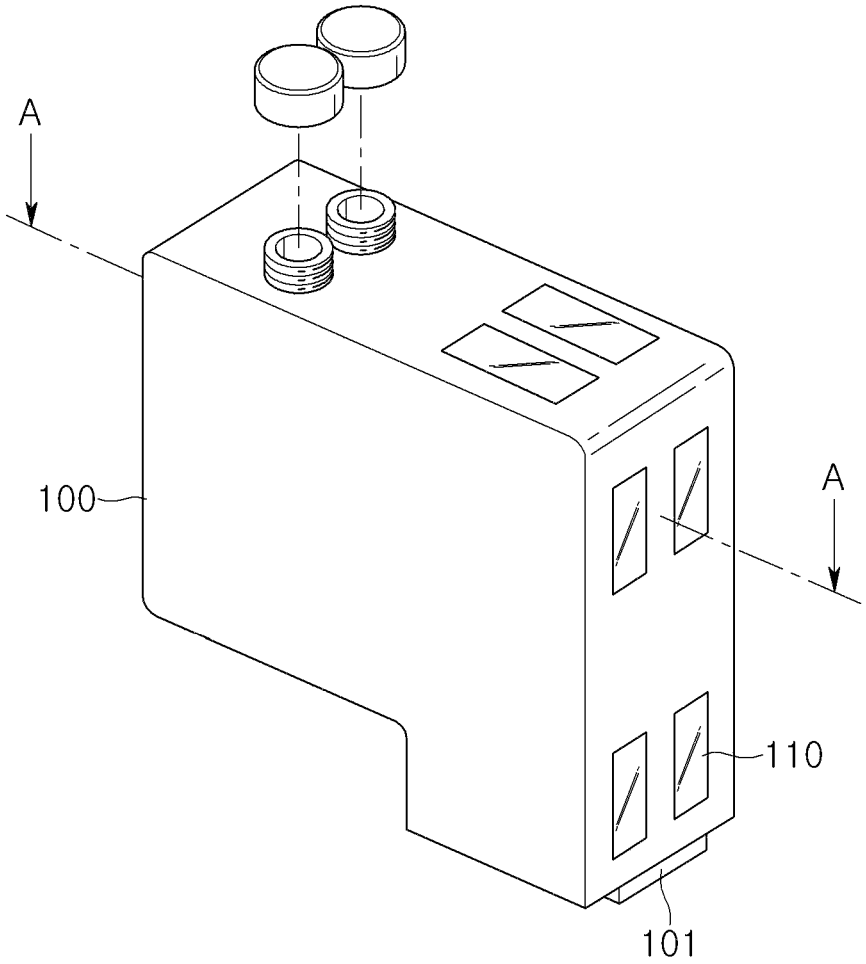
FIGS. 5 and 6 are perspective views schematically illustrating shapes of a reusable ink cartridge for an inkjet printer, according to other embodiments.
Figure 6:
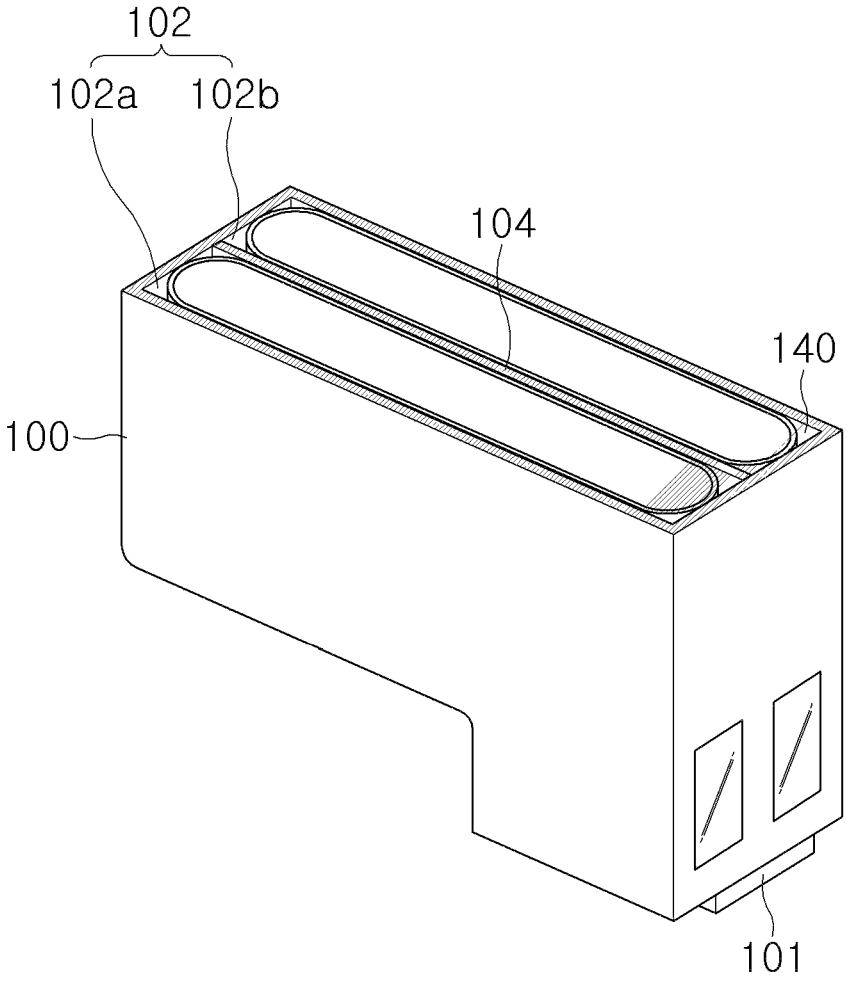

FIGS. 5 and 6 are perspective views schematically illustrating shapes of a reusable ink cartridge for an inkjet printer, according to other embodiments.

The ink cartridge according to another embodiment of the present invention may be configured such that the ink storage chamber 102 provided in the internal space of the main body housing 100 is divided via at least one barrier wall 104. For example, as shown in FIGS. 5 and 6, one barrier wall 104 may be provided in the internal space of the main body housing 100, and accordingly, the ink storage chamber 102 may be divided into two independent spaces 102*a* and 102*b*.

When the ink storage chamber 102 is divided as such, ink having different colors may be stored in the ink storage chambers 102*a* and 102*b*. In other words, when the ink cartridge is a color ink cartridge, the internal space of the main body using 100 may be divided based on colors as shown in FIGS. 5 and 6.

At this time, the storage amount display window 110 and the refilling amount display window 120 provided at the side surface of the main body housing 100 may be correspondingly provided at the ink storage chambers 102*a* and 102*b* such that internal spaces of the ink storage chambers 102*a* and 102*b* divided by the barrier wall 104 are observed from the outside. Also, as shown in FIG. 6, the separate refill bag 140 may be provided at each of the ink storage chambers 102*a* and 102*b*.

While this invention has been particularly shown and described with reference to embodiments thereof, it will be understood by those of ordinary skill in the art that various changes in form and details may be made therein without departing from the spirit and scope of the invention as defined by the appended claims. The embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. A reusable ink cartridge for an inkjet printer, the reusable ink cartridge comprising:

a main body housing having an ink storage chamber in which ink is stored;

a refilling port provided at an upper surface of the main body housing such that ink is refilled in the ink storage chamber of the main body housing; and a port cover detachably combined to the refilling port to open or close the refilling port, wherein the ink cartridge is used by refilling ink in the ink storage chamber through the refilling port;

wherein a storage amount display window is provided at a side lower portion of the main body housing such that a storage height of ink stored in the ink storage chamber is observed with naked eyes from the outside, and a refilling amount display window is provided at a side upper portion of the main body housing such that a refilling height of ink is observed with naked eyes from the outside while refilling ink in the ink storage chamber; and wherein an infrared filter or ultraviolet filter is mounted on the storage amount display window and the refilling amount display window such that infrared rays or ultraviolet rays are blocked.

2. The reusable ink cartridge of claim 1, wherein the ink storage chamber provided in an inner space of the main body housing are divided through at least one barrier wall, and the storage amount display window and the refilling amount display window are provided correspondingly to the ink storage chamber divided through the at least one barrier wall.

3. The reusable ink cartridge of claim 1, further comprising a refill bag formed of a ductile material inside the ink storage chamber to store ink therein, wherein the refill bag is communicably mounted on the refilling port such that ink refilled through the refilling port flows into and stored in an inner space of the refill bag.

4. The reusable ink cartridge of claim 3, wherein an air vent is provided at one side of the main body housing such that external air flows into and discharges from an inner space of the ink storage chamber.

5. The reusable ink cartridge of claim 3, wherein the refill bag has a refilling inlet hole to communicate with the refilling port, wherein the refilling inlet hole is communicably fixed to the refilling port via a separate adhesive.

* * * * *